US009389539B1

(12) United States Patent
Somemiya et al.

(10) Patent No.: US 9,389,539 B1
(45) Date of Patent: Jul. 12, 2016

(54) IMAGE FORMING APPARATUS WITH TRANSPORT DEVICES HAVING DIFFERING CONFIGURATIONS

(71) Applicant: FUJI XEROX CO., LTD., Tokyo (JP)

(72) Inventors: Tsutomu Somemiya, Kanagawa (JP); Tetsuji Okamoto, Kanagawa (JP); Takuji Matsumoto, Kanagawa (JP); Atsuna Saiki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/887,719

(22) Filed: Oct. 20, 2015

(30) Foreign Application Priority Data

Apr. 30, 2015 (JP) ..... 2015-092656

(51) Int. Cl.
*G03G 15/08* (2006.01)

(52) U.S. Cl.
CPC ..... *G03G 15/0887* (2013.01)

(58) Field of Classification Search
CPC ..... G03G 15/0887; G03G 15/0865; G03G 15/0877; G03G 15/0872; G03G 15/0891
USPC ..... 399/111, 119, 254, 258, 260
See application file for complete search history.

(56) References Cited

U.S. PATENT DOCUMENTS

| | | | | |
|---|---|---|---|---|
| 7,929,885 | B2 | 4/2011 | Sakuma | |
| 2008/0187357 | A1* | 8/2008 | Miura | G03G 15/0896 399/120 |
| 2011/0064475 | A1* | 3/2011 | Yoshida | G03G 15/0126 399/258 |
| 2012/0163872 | A1* | 6/2012 | Hayashi | G03G 15/0887 399/254 |
| 2012/0251167 | A1* | 10/2012 | Matsumoto | G03G 15/0813 399/111 |

FOREIGN PATENT DOCUMENTS

| | | | |
|---|---|---|---|
| JP | 2003-107885 | A | 4/2003 |
| JP | 2009-156993 | A | 7/2009 |
| JP | 2010181762 | A * | 8/2010 |

* cited by examiner

*Primary Examiner* — Francis Gray
(74) *Attorney, Agent, or Firm* — Oliff PLC

(57) ABSTRACT

An image forming apparatus includes an apparatus body; plural developing devices arranged in a first direction in the apparatus body; plural developer housing containers that are arranged in a second direction intersecting with the first direction and house developers to be respectively supplied to the developing devices; plural transport devices that respectively transport the developers to the developing devices from the developer housing containers; an intermediate transfer; and a transfer device. The developing devices include a first developing device located near the transfer device, and a second developing device located farther from the transfer device than the first developing device. The transport devices include first and second transport devices that respectively transports developers to the first and second developing devices. A transport distance of the developer transported the first transport is larger than that of the developer transported by the second transport device.

10 Claims, 10 Drawing Sheets

IMAGE FORMING APPARATUS WITH TRANSPORT DEVICES HAVING DIFFERING CONFIGURATIONS

CROSS-REFERENCE TO RELATED APPLICATIONS

This application is based on and claims priority under 35 USC 119 from Japanese Patent Application No. 2015-092656 filed Apr. 30, 2015.

BACKGROUND

The present invention relates to an image forming apparatus.

SUMMARY

According to an aspect of the invention, there is provided an image forming apparatus including an apparatus body; plural developing devices arranged in a first direction in the apparatus body; plural developer housing containers that house developers to be respectively supplied to the plural developing devices, the plural developer housing containers being arranged in a second direction intersecting with the first direction; plural transport devices that respectively transport the developers to the plural developing devices respectively corresponding to the plural developer housing containers from the plural developer housing containers; an intermediate transfer body on which developer images developed by the plural developing devices are transferred; and a transfer device that transfers the developer images from the intermediate transfer body to a recording medium. The plural developing devices include a first developing device located near the transfer device, and a second developing device located farther from the transfer device than the first developing device. The plural transport devices include a first transport device that transports a developer to the first developing device, and a second transport device that transports a developer to the second developing device. A transport distance by which the first transport device transports the developer is larger than a transport distance by which the second transport device transports the developer.

BRIEF DESCRIPTION OF THE DRAWINGS

An exemplary embodiment of the present invention will be described in detail based on the following figures, wherein.

DETAILED DESCRIPTION

Figure 1:
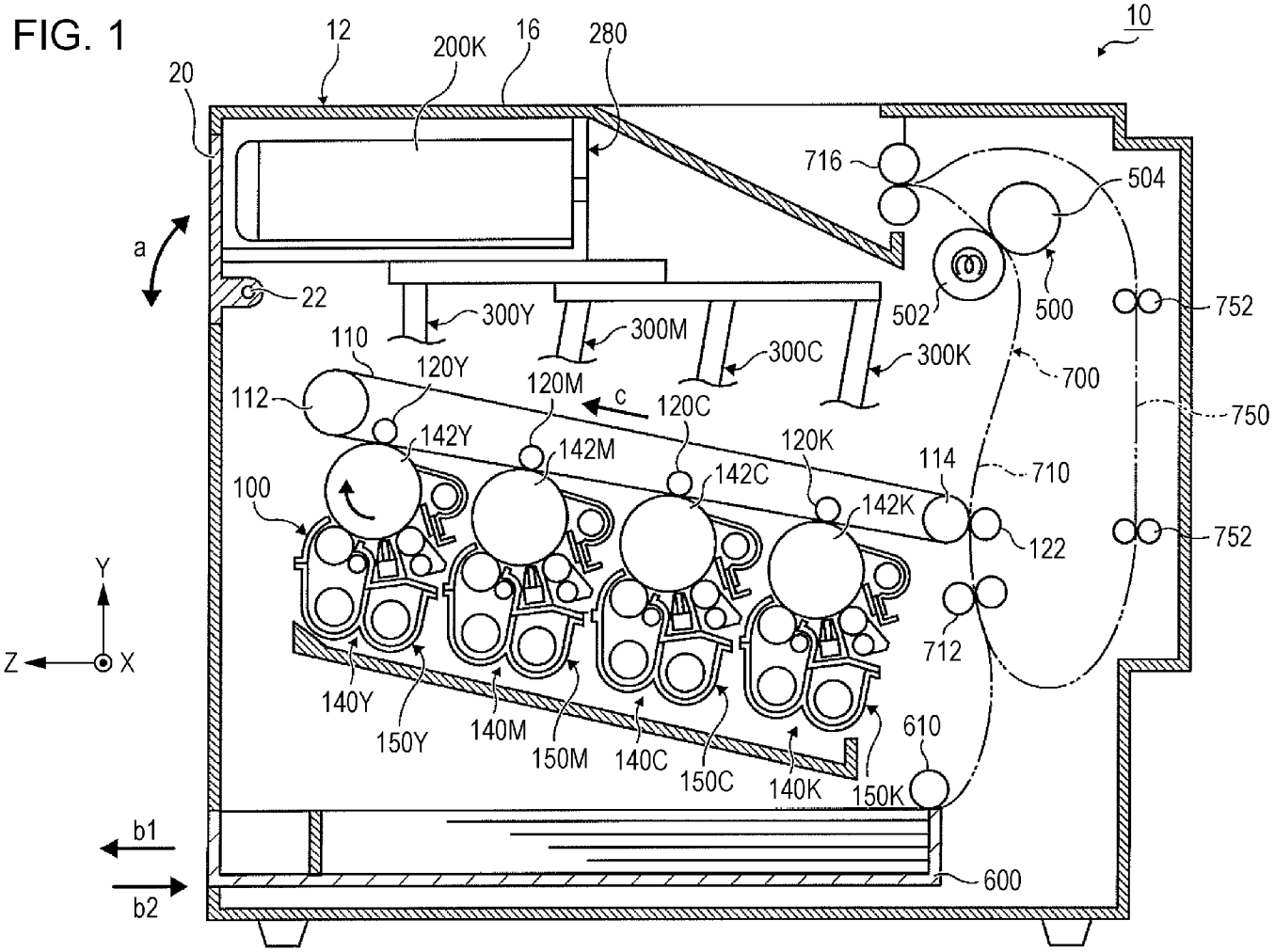
FIG. 1 is a cross-sectional view showing an image forming apparatus according to an exemplary embodiment of the present invention when viewed from a right side surface.

Next, an exemplary embodiment of the present invention is described with reference to the drawings. FIG. 1 shows an image forming apparatus 10 according to the exemplary embodiment of the present invention. In the following description, it is assumed that a direction from the left side to the right side of the image forming apparatus 10 represents an X-axis direction, a direction from the lower side to the upper side represents a Y-axis direction, and a direction from the rear side to the front side of the image forming apparatus 10 represents a Z-axis direction.

As shown in FIG. 1, the image forming apparatus 10 includes an apparatus body 12, and a surface at the upper side of the apparatus body 12 is used as an output portion 16. A sheet used as a recording medium and having a toner image being a developer image formed thereon is output to the output portion 16.

An opening/closing portion 20 is attached to a surface at the front side of the apparatus body 12. The opening/closing portion 20 is openable and closable with respect to the apparatus body 12. The opening/closing portion 20 rotates around a shaft member 22 as indicated by an arrow a and hence may be opened and closed with respect to the apparatus body 12 (see FIG. 4 for an open state in which the opening/closing portion 20 is opened with respect to the apparatus body).

The image forming apparatus 10 includes a sheet housing portion 600. The sheet housing portion 600 is used as a recording medium housing portion. The sheet housing portion 600 may be pulled out toward the front side from the apparatus body 12 as indicated by an arrow b1. The sheet housing portion 600 may be pushed toward the rear side into the apparatus body 12 as indicated by an arrow b2. Thus, the sheet housing portion 600 is mounted to the apparatus body 12.

The image forming apparatus 10 further includes an image forming section 100 and a fixing device 500. A sheet transport path 700 is formed in the apparatus body 12.

The image forming section 100 includes an intermediate transfer belt 110. On the intermediate transfer belt 110, toner images (developer images) respectively formed by developing devices 150Y, 150M, 150C, and 150K (described later) are transferred. The intermediate transfer belt 110 is supported by, for example, two support rollers 112 and 114, and rotates in an arrow c direction.

The image forming section 100 includes plural, for example, four image forming units 140. To be more specific, the image forming section 100 includes an image forming unit 140Y that forms a toner image of yellow color (hereinafter, referred to as yellow toner image), an image forming unit 140M that forms a toner image of magenta color (hereinafter, referred to as magenta toner image), an image forming unit 140C that forms a toner image of cyan color (hereinafter, referred to as cyan toner image), and an image forming unit 140K that forms a toner image of black color (hereinafter, referred to as black toner image).

The image forming units 140Y, 140M, 140C, and 140K respectively include photoconductor drums 142Y, 142M, 142C, and 142K used as image holding bodies, and respectively include the developing devices 150Y, 150M, 150C, and 150K. In this case, a direction, in which the developing devices 150Y, 150M, 150C, and 150K are arranged, indicated by an arrow d (see FIG. 3) represents a first direction. The details of the image forming units 140Y, 140M, 140C, and 140K are described later.

The image forming section 100 further includes first transfer rollers 120Y, 120M, 120C, and 120K. The first transfer rollers 120Y, 120M, 120C, and 120K transfer toner images respectively formed by the photoconductor drums 142Y, 142M, 142C, and 142K, on the intermediate transfer belt 110.

The sheet transport path 700 includes a main transport path 710 and a reverse transport path 750. The main transport path 710 is a transport path for transporting a sheet from the above-described sheet housing portion 600 to the above-described output portion 16. A sending roller 610, a registration roller 712, a second transfer roller 122, the fixing device 500, and an output roller 716 are arranged along the main transport path 710 in the order from the upstream side in a sheet transport direction.

The sending roller 610 sends out a sheet at the top of sheets housed in the sheet housing portion 600 to the sheet transport path 700. The registration roller 712 temporarily stops movement of the leading edge of the sheet sent out by the sending roller 610, and re-starts the movement of the leading edge of the sheet to meet a timing at which an image transferred on the intermediate transfer belt 110 reaches the position of the second transfer roller 122.

The second transfer roller 122 is used as a transfer device that transfers a toner image from the intermediate transfer belt 110 to a sheet. The second transfer roller 122 transfers the toner image to the sheet supplied from the registration roller 712.

The fixing device 500 fixes the toner image transferred on the sheet by the second transfer roller 122 to the sheet by using, for example, heat and pressure. The fixing device 500 includes, for example, a heating roller 502 and a pressing roller 504.

The output roller 716 outputs the sheet with the toner image fixed by the fixing device 500, to the output portion 16. However, after the toner image is formed on one surface of the sheet, if a toner image is also formed on the other surface of the sheet, the output roller 716 rotates in the opposite direction at a timing when a portion near the trailing edge of the sheet reaches the position at which the sheet contacts the output roller 716, and the sheet having the toner image formed on the one surface is sent to the reverse transport path 750 from the trailing edge side.

The reverse transport path 750 is a transport path for transporting the sheet having the toner image formed on the one surface toward the upstream side of the registration roller 712 in the main transport path 710 while reversing the sheet. For example, two transport rollers 752 are arranged along the reverse transport path 750. The sheet sent out from the output roller 716 to the reverse transport path 750 is transported to the main transport path 710 by the transport rollers 752.

The image forming apparatus 10 includes, for example, four toner housing containers 200, the number of which is equivalent to the number of the developing devices 150. To be more specific, the image forming apparatus 10 includes toner housing containers 200Y, 200M, 200C, and 200K (FIG. 1 only illustrates the toner housing container 200K, and see FIG. 3 for the other toner housing containers). The toner housing containers 200Y, 200M, 200C, and 200K are used as developer housing containers, and respectively house a toner of yellow color (hereinafter, referred to as yellow toner) to be supplied to the developing device 150Y, a toner of magenta color (hereinafter, referred to as magenta toner) to be supplied to the developing device 150M, a toner of cyan color (hereinafter, referred to as cyan toner) to be supplied to the developing device 150C, and a toner of black color (hereinafter, referred to as black toner) to be supplied to the developing device 150K. In this case, a direction, in which the toner housing containers 200Y, 200M, 200C, and 200K are arranged, indicated by an arrow e (see FIG. 3) represents a second direction.

The toner housing containers 200Y, 200M, 200C, and 200K are arranged below the output portion 16 in the gravity direction (also see FIG. 4).

The image forming apparatus 10 includes an attachment device 280 to which the toner housing containers 200Y, 200M, 200C, and 200K are attached.

The image forming apparatus 10 includes, for example, four toner transport devices 300, the number of which is equivalent to the number of the developing devices 150 and the number of the toner housing containers 200. To be more specific, the image forming apparatus 10 includes toner transport devices 300Y, 300M, 300C, and 300K. The toner transport device 300Y transports the yellow toner from the toner housing container 200Y to the developing device 150Y, the toner transport device 300M transports the magenta toner from the toner housing container 200M to the developing device 150M, the toner transport device 300C transports the cyan toner from the toner housing container 200C to the developing device 150C, and the toner transport device 300K transports the black toner from the toner housing container 200K to the developing device 150K. The details of the toner transport devices 300Y, 300M, 300C, and 300K are described later.

Figure 2:
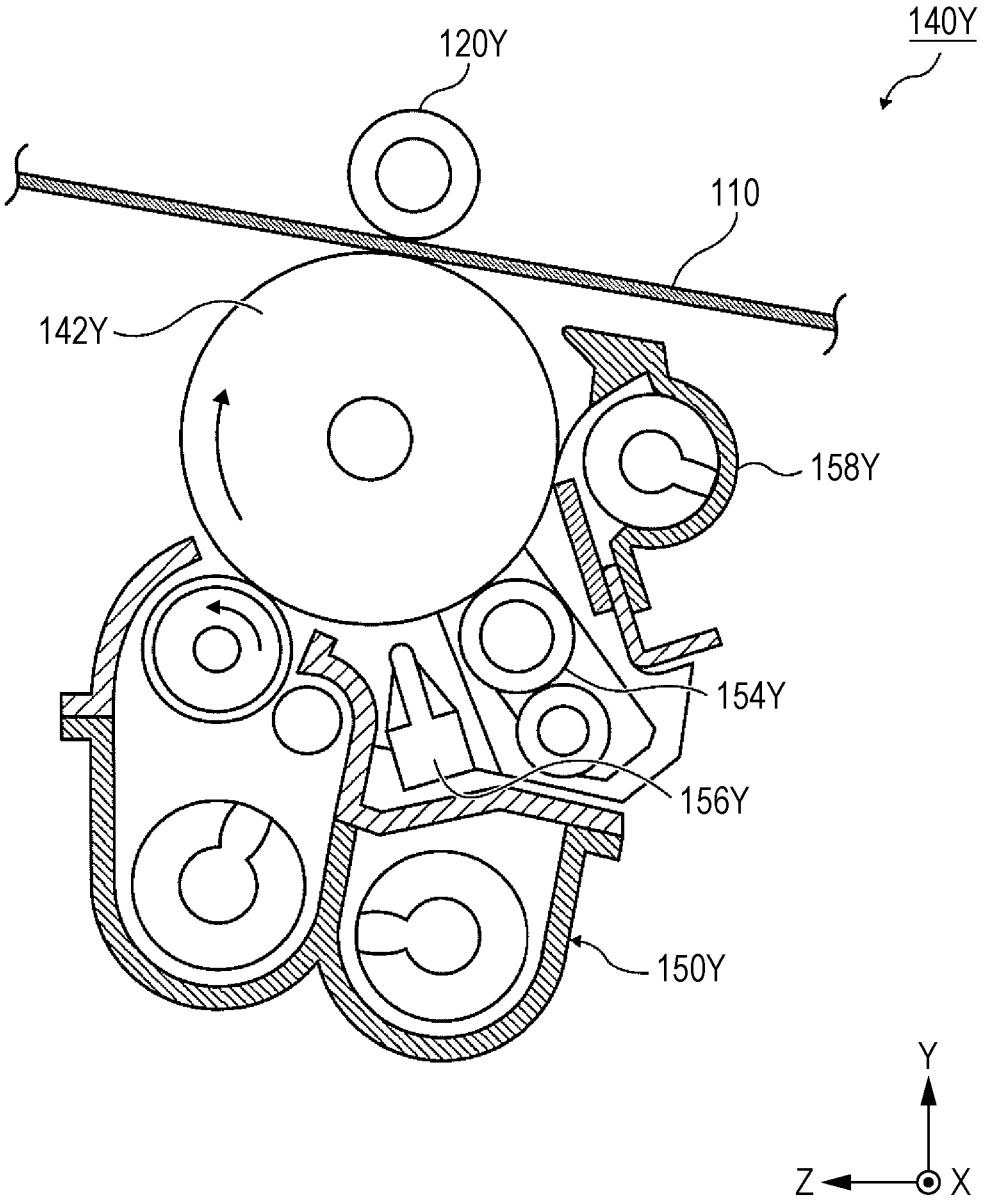
FIG. 2 is a cross-sectional view showing an image forming unit included in the image forming apparatus shown in FIG. 1 when viewed from a right side surface.

FIG. 2 shows the image forming unit 140Y. The image forming units 140Y, 140M, 140C, and 140K have the same configuration. Hence, the configuration of the image forming unit 140Y is described below, and the description for the image forming units 140M, 140C, and 140K is omitted.

As shown in FIG. 2, the image forming unit 140Y includes the above-described photoconductor drum 142Y and the above-described developing device 150Y. The image forming unit 140Y further includes a charging device 154Y that electrically charges the photoconductor drum 142Y; a latent image forming device 156Y that forms a latent image on the surface of the photoconductor drum 142Y by irradiating the surface of the photoconductor drum 142Y electrically charged by the charging device 154Y with light; and a cleaning device 158Y that removes a toner etc. remaining on the photoconductor drum 142Y after the toner image is transferred to the intermediate transfer belt 110 by the first transfer roller 120Y and hence cleans the photoconductor drum 142Y.

Figure 3:
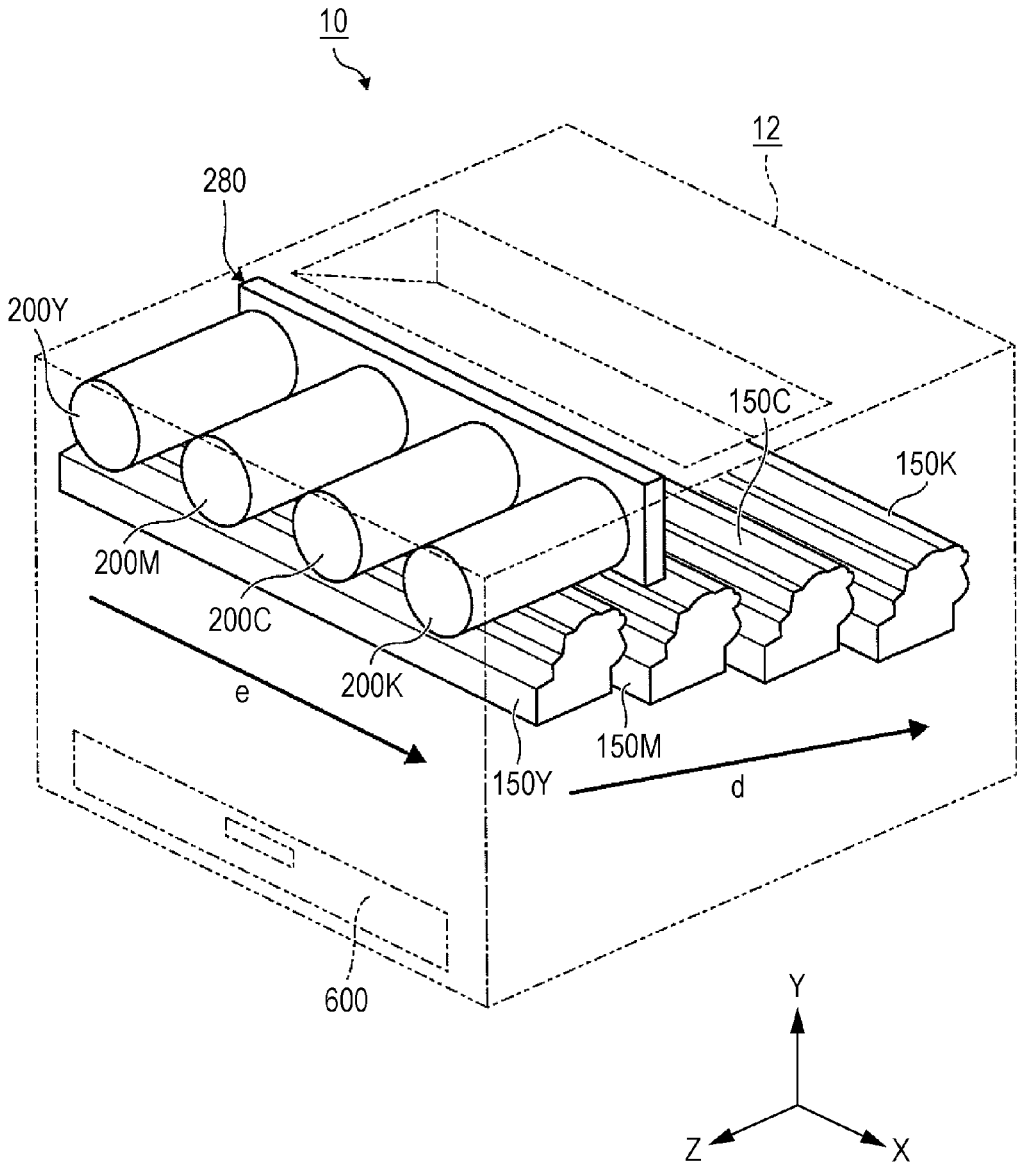
FIG. 3 is an illustration explaining an arrangement of developing devices and developer housing containers in an apparatus body included in the image forming apparatus shown in FIG. 1.

FIG. 3 shows an arrangement of the developing devices 150Y, 150M, 150C, and 150K and the toner housing containers 200Y, 200M, 200C, and 200K in the apparatus body 12.

The developing devices 150Y, 150M, 150C, and 150K are arranged in the first direction indicated by the arrow d as described above. The toner housing containers 200Y, 200M, 200C, and 200K are arranged in the second direction indicated by the arrow e as described above. The second direction intersects with the first direction as shown in FIG. 3.

The order in the first direction of the colors of the developer images respectively formed by the developing devices 150Y, 150M, 150C, and 150K and the order in the second direction of the colors of the toners (the developers) respectively housed in the toner housing containers 200Y, 200M, 200C, and 200K are the order of yellow, magenta, cyan, and black, and hence are the same.

Figure 4:
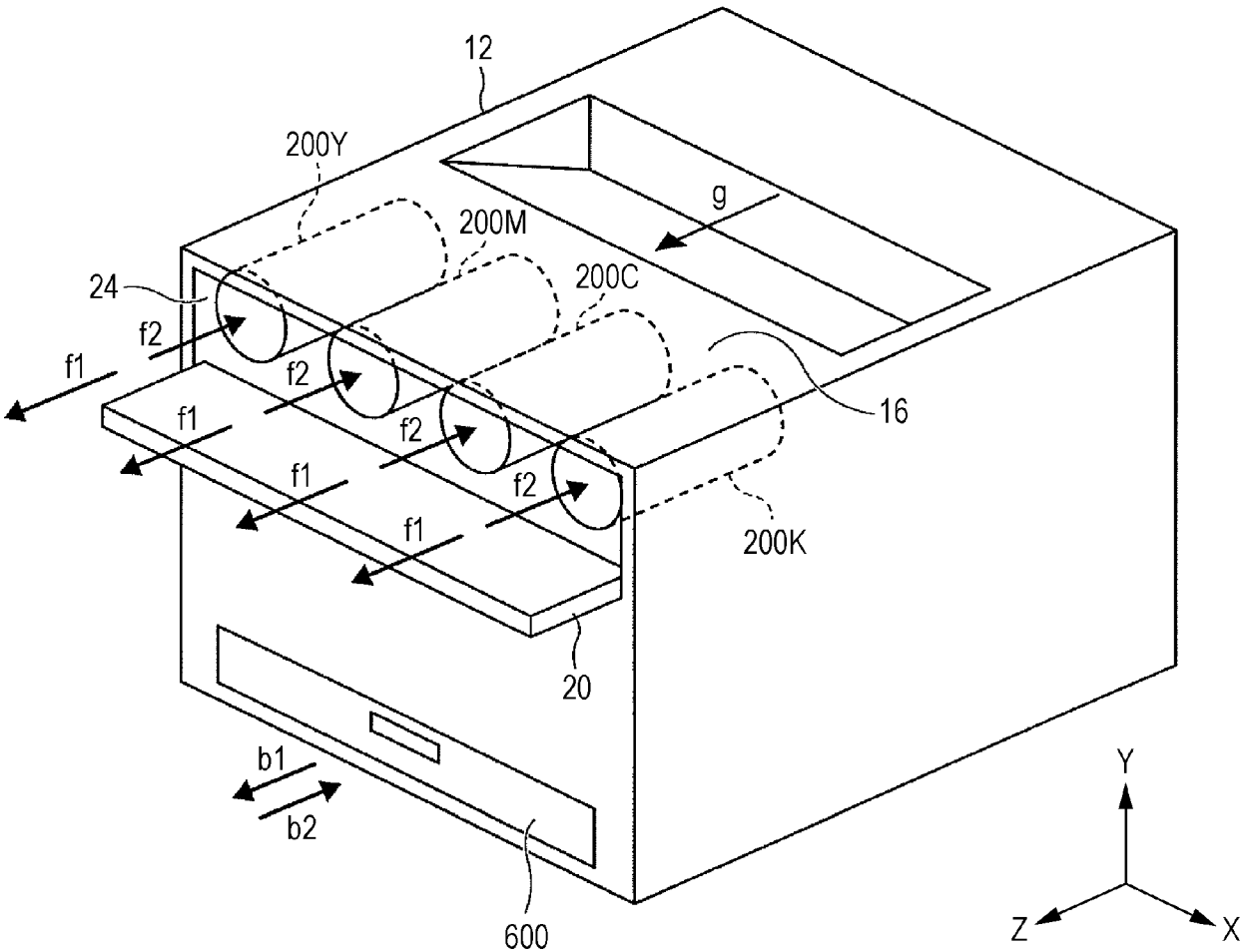
FIG. 4 is an illustration explaining attachment and detachment of the developer housing containers to and from the apparatus body of the image forming apparatus shown in FIG. 1.

FIG. 4 illustrates attachment and detachment of the toner housing containers 200Y, 200M, 200C, and 200K to and from the apparatus body 12. The toner housing containers 200Y, 200M, 200C, and 200K are attached to the apparatus body 12 through an open portion 24 formed when the opening/closing portion 20 is opened.

The toner housing containers 200Y, 200M, 200C, and 200K are moved in a direction indicated by an arrow f1 and detached from the apparatus body 12, in a direction the same as the direction indicated by the arrow b1 in which the sheet housing portion 600 is pulled out from the apparatus body 12; and the toner housing containers 200Y, 200M, 200C, and 200K are moved in a direction indicated by an arrow f2 and attached to the apparatus body 12, in a direction opposite to the direction indicated by the arrow b1 in which the sheet housing portion 600 is pulled out from the apparatus body 12.

The toner housing containers 200Y, 200M, 200C, and 200K are moved in the direction indicated by the arrow f1 and detached from the apparatus body 12, in a direction the same as an arrow g in FIG. 4 in which a sheet with an image formed is output from the apparatus body 12; and the toner housing containers 200Y, 200M, 200C, and 200K are moved in the direction indicated by the arrow f2 and attached to the apparatus body 12, in a direction opposite to the arrow g in FIG. 4 in which the sheet with the image formed is output from the apparatus body 12.

Figure 5A:
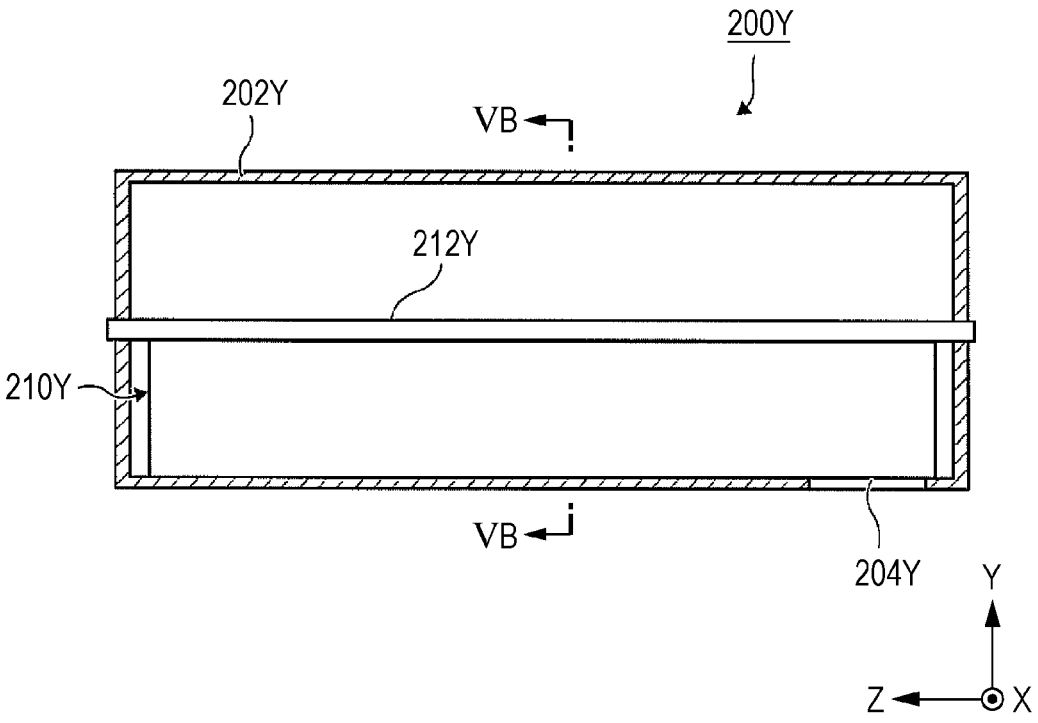
FIGS. 5A and 5B show a developer housing container included in the image forming apparatus shown in FIG. 1, FIG. 5A being a cross-sectional view of the developer housing container when viewed from a right side surface, FIG. 5B being a cross-sectional view taken along line VB-VB in FIG. 5A.
Figure 5B:
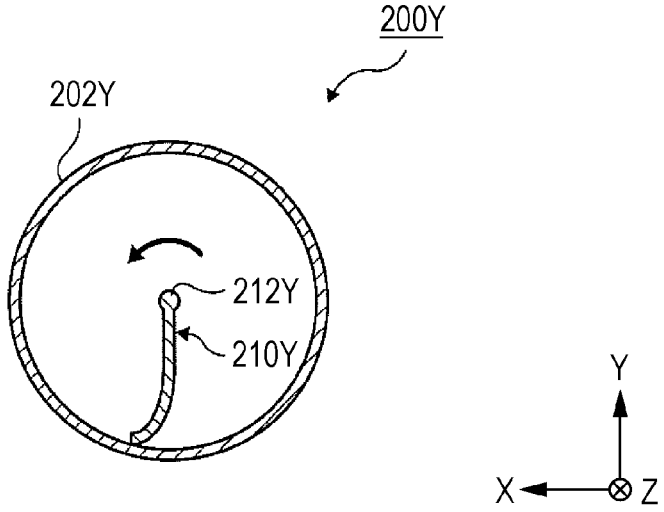

FIGS. 5A and 5B show the toner housing container 200Y. The toner housing containers 200Y, 200M, 200C, and 200K have the same configuration. Hence, the configuration of the toner housing container 200Y is described below, and the description for the toner housing containers 200M, 200C, and 200K is omitted.

As shown in FIGS. 5A and 5B, the toner housing container 200Y includes, for example, a cylindrical housing container body 202Y. The housing container body 202Y houses the yellow toner therein. The housing container body 202Y also has a discharge port 204Y for discharging the housed yellow toner. The housing container body 202Y has a stirring member 210Y attached thereto by using a rotation shaft 212Y. In the toner housing container 200Y, the rotation shaft 212Y and the stirring member 210Y are rotated together, hence the yellow toner housed in the housing container body 202Y is stirred, the stirred yellow toner is discharged from the discharge port 204Y, and the discharged yellow toner is supplied to the toner transport device 300Y.

Figure 9A:
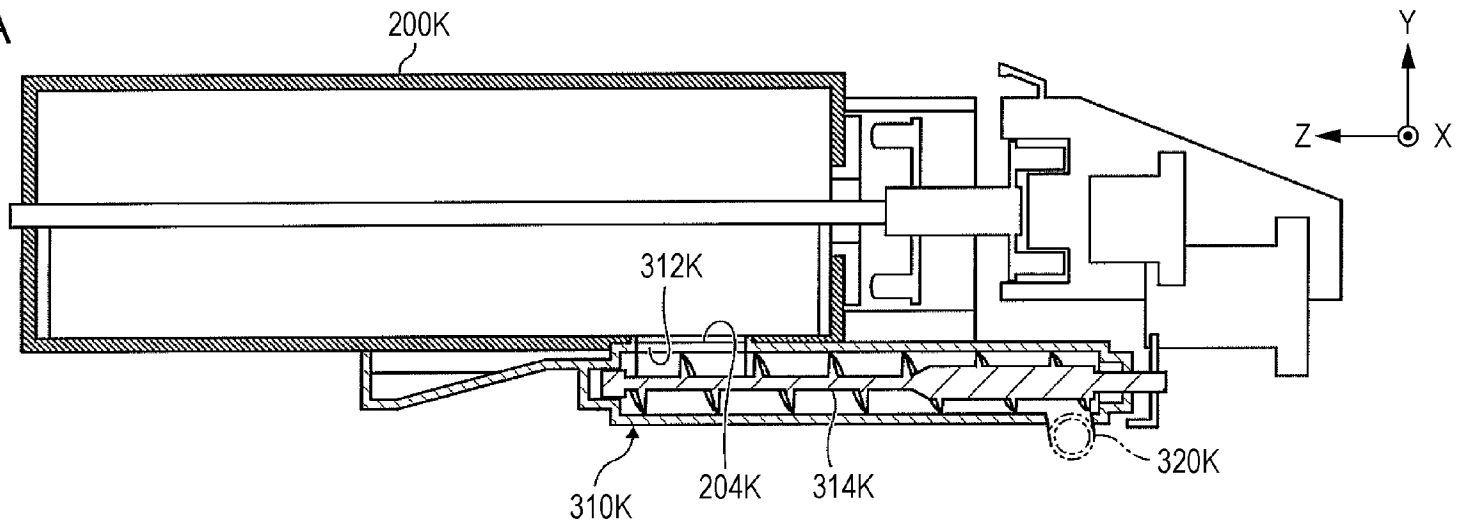
FIG. 9A is a cross-sectional view showing an upstream transport portion included in a developer transport device that transports a toner of black, the device which is one of the plural developer transport devices shown in FIG. 6, when viewed from a right side surface.

A discharge port in the toner housing container 200M from which the magenta toner is discharged is a discharge port 204M (not shown), a discharge port in the toner housing container 200C from which the cyan toner is discharged is a discharge port 204C (not shown), and a discharge port in the toner housing container 200K from which the black toner is discharged is a discharge port 204K (see FIG. 9A).

Figure 6:
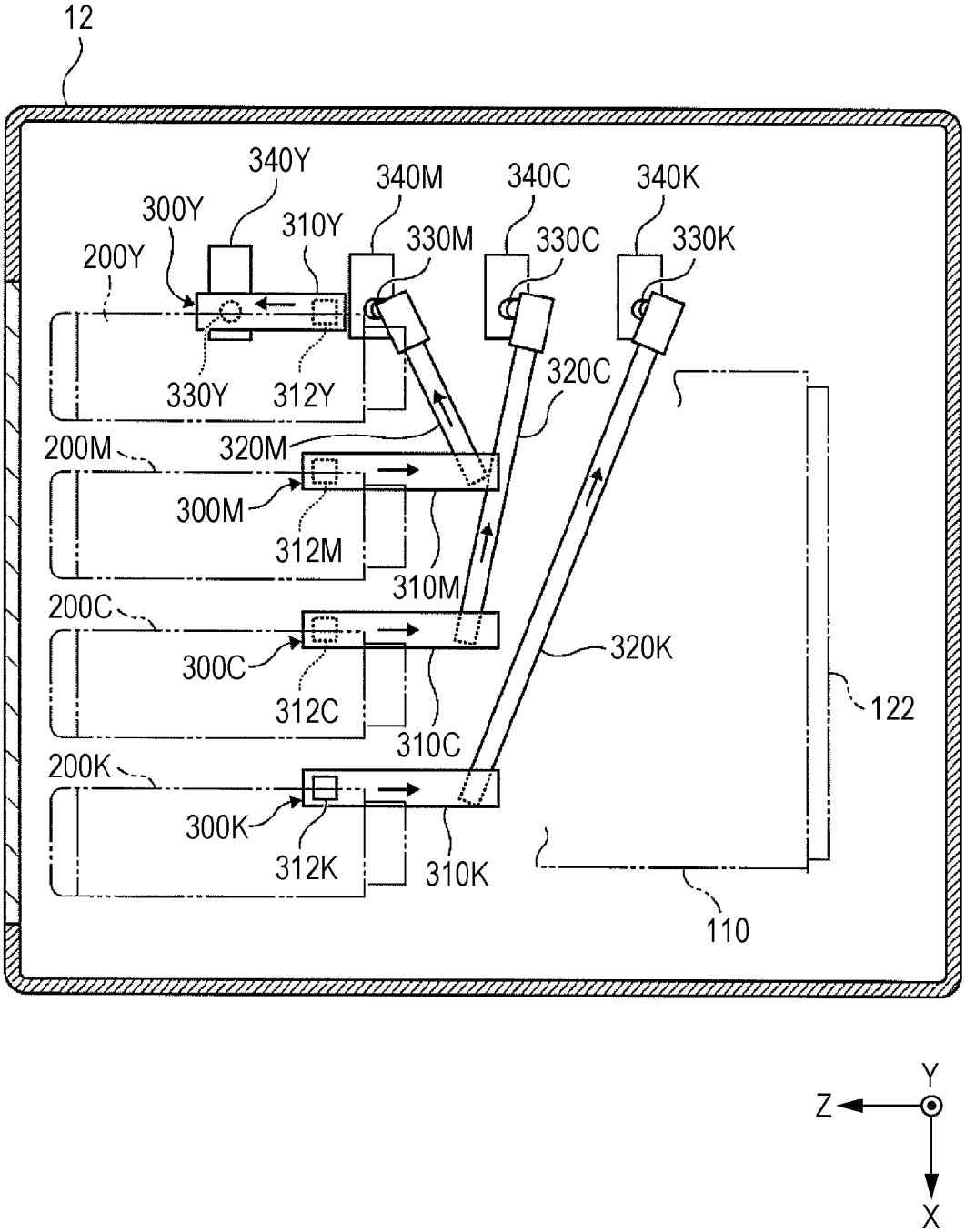
FIG. 6 is an illustration explaining an arrangement in the apparatus body of plural developer transport devices included in the image forming apparatus shown in FIG. 1.
Figure 7:
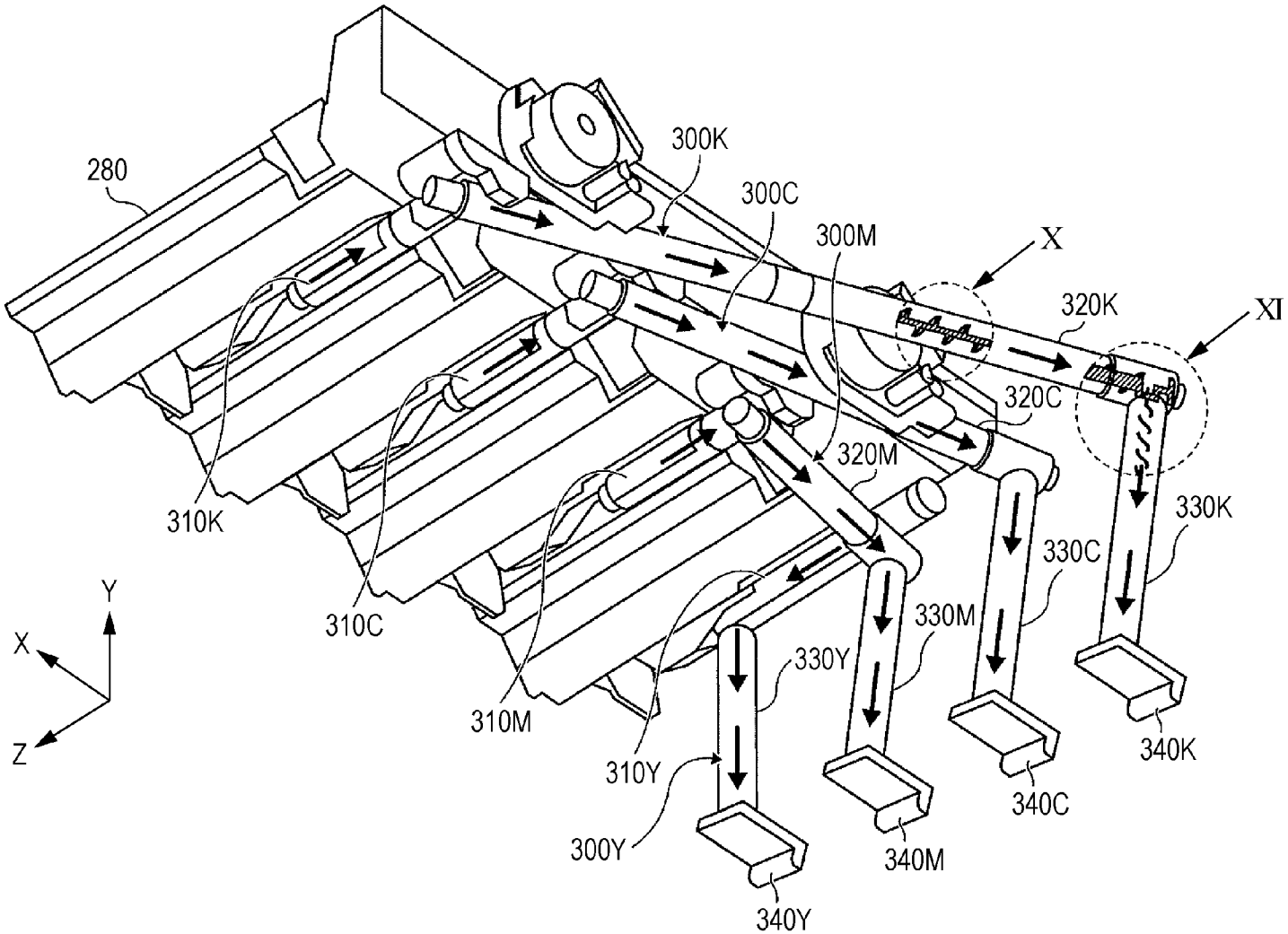
FIG. 7 is a perspective view showing the developer transport devices shown in FIG. 6 when viewed from a lower right side.
Figure 8:
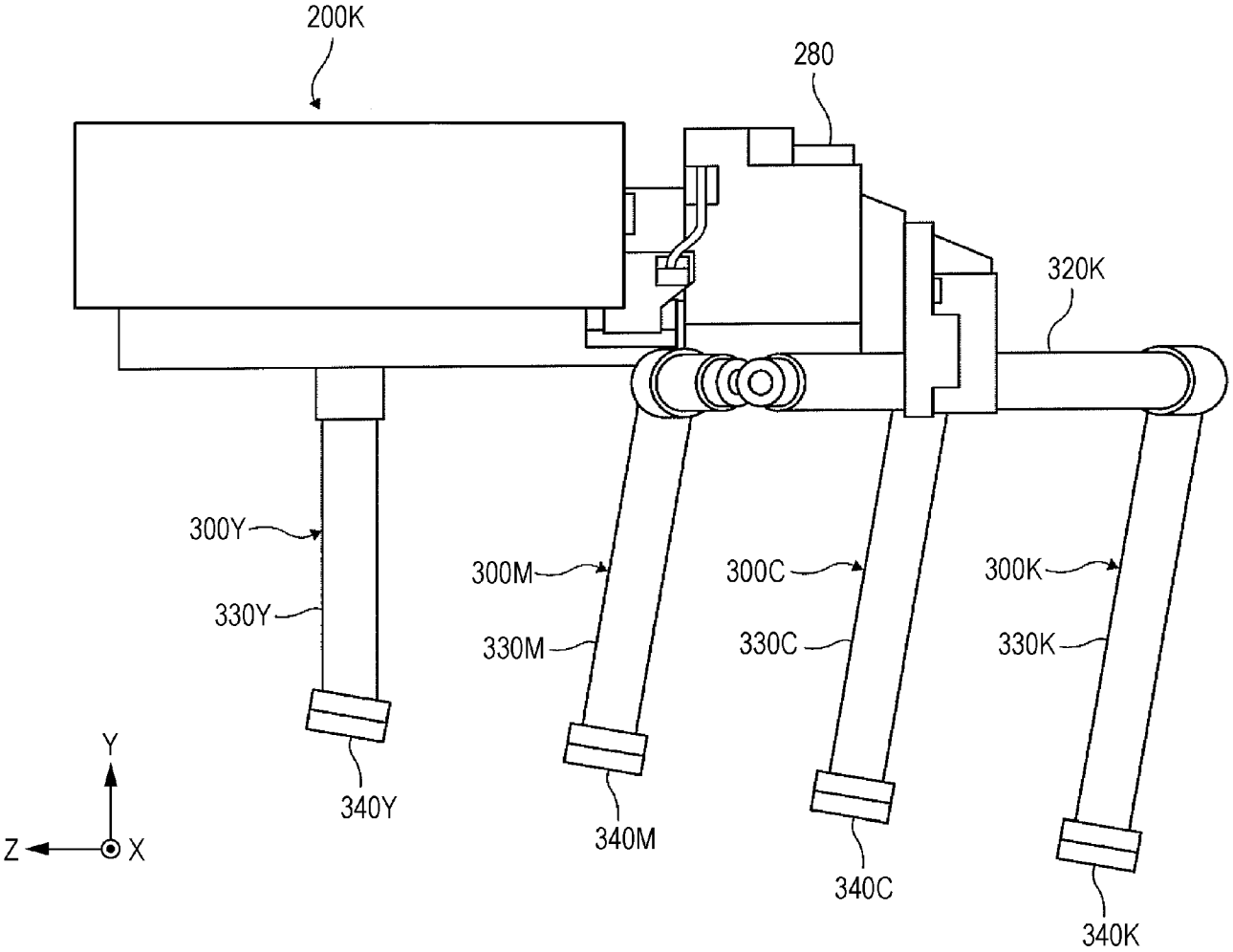
FIG. 8 is an illustration showing the developer transport devices shown in FIG. 6 when viewed from right side surfaces.

FIGS. 6, 7, and 8 show the toner transport devices 300Y, 300M, 300C, and 300K. As shown in FIGS. 6, 7, and 8, the toner transport device 300K includes an upstream transport portion 310K, an intermediate transport portion 320K, and a downstream transport portion 330K. The upstream transport portion 310K, the intermediate transport portion 320K, and the downstream transport portion 330K each have a pipe shape, and transport the black toner by guiding the black toner through the pipes.

The upstream transport portion 310K has an insertion opening 312K formed at a position at the front side and facing the upper side. The black toner discharged from the discharge port 204K (see FIG. 9A) of the toner housing container 200K is inserted into the upstream transport portion 310K through the insertion opening 312K. The upstream transport portion 310K transports the inserted black toner from the front side to the rear side (from the left side to the right side in FIG. 6). A rear end portion of the upstream transport portion 310K is coupled to one end portion of the intermediate transport portion 320K.

The one end portion of the intermediate transport portion 320K is coupled to the upstream transport portion 310K, and the other end portion thereof is coupled to the downstream transport portion 330K. The intermediate transport portion 320K transports the black toner transported from the upstream transport portion 310K to the downstream transport portion 330K.

An upper end portion of the downstream transport portion 330K is coupled to the intermediate transport portion 320K, and a developing device connection portion 340K is attached to a lower end portion of the downstream transport portion 330K. The developing device connection portion 340K is a mechanism to which the developing device 150K (for example, see FIG. 3) is connected. The downstream transport portion 330K transports the black toner transported from the intermediate transport portion 320K to the developing device 150K through the developing device connection portion 340K.

The toner transport device 300C includes an upstream transport portion 310C, an intermediate transport portion 320C, and a downstream transport portion 330C. The upstream transport portion 310C, the intermediate transport portion 320C, and the downstream transport portion 330C each have a pipe shape, and transport the cyan toner by guiding the cyan toner through the pipes.

The upstream transport portion 310C has an insertion opening 312C formed at a position at the front side and facing the upper side. The cyan toner discharged from the discharge port 204C (not shown, see the discharge port 204Y shown in FIG. 5A) of the toner housing container 200C is inserted into the upstream transport portion 310C through the insertion opening 312C. The upstream transport portion 310C transports the inserted cyan toner from the front side to the rear side. A rear end portion of the upstream transport portion 310C is coupled to one end portion of the intermediate transport portion 320C.

The one end portion of the intermediate transport portion 320C is coupled to the upstream transport portion 310C, and the other end portion thereof is coupled to the downstream transport portion 330C. The intermediate transport portion 320C transports the cyan toner transported from the upstream transport portion 310C to the downstream transport portion 330C.

An upper end portion of the downstream transport portion 330C is coupled to the intermediate transport portion 320C, and a developing device connection portion 340C is attached to a lower end portion of the downstream transport portion 330C. The developing device connection portion 340C is a mechanism to which the developing device 150C (for example, see FIG. 3) is connected. The downstream transport portion 330C transports the cyan toner transported from the intermediate transport portion 320C to the developing device 150C through the developing device connection portion 340C.

The toner transport device 300M includes an upstream transport portion 310M, an intermediate transport portion 320M, and a downstream transport portion 330M. The upstream transport portion 310M, the intermediate transport portion 320M, and the downstream transport portion 330M each have a pipe shape, and transport the magenta toner by guiding the magenta toner through the pipes.

The upstream transport portion 310M has an insertion opening 312M formed at a position at the front side and facing the upper side. The magenta toner discharged from the discharge port 204M (not shown, see the discharge port 204Y shown in FIG. 5A) of the toner housing container 200M is inserted into the upstream transport portion 310M through the insertion opening 312M. The upstream transport portion 310M transports the inserted magenta toner from the front side to the rear side. A rear end portion of the upstream transport portion 310M is coupled to one end portion of the intermediate transport portion 320M.

The one end portion of the intermediate transport portion 320M is coupled to the upstream transport portion 310M, and the other end portion thereof is coupled to the downstream transport portion 330M. The intermediate transport portion 320M transports the magenta toner transported from the upstream transport portion 310M to the downstream transport portion 330M.

An upper end portion of the downstream transport portion 330M is coupled to the intermediate transport portion 320M, and a developing device connection portion 340M is attached to a lower end portion of the downstream transport portion 330M. The developing device connection portion 340M is a mechanism to which the developing device 150M (for example, see FIG. 3) is connected. The downstream transport portion 330M transports the magenta toner transported from the intermediate transport portion 320M to the developing device 150M through the developing device connection portion 340M.

As described above, the toner transport devices 300M, 300C, and 300K respectively include the intermediate transport portions 320M, 320C, and 320K. In contrast, the toner transport device 300Y does not include an intermediate transport portion, and includes an upstream transport portion 310Y and a downstream transport portion 330Y. To be more specific, the toner transport device 300Y includes the pipe-shaped upstream transport portion 310Y and the pipe-shaped downstream transport portion 330Y, and transports the yellow toner by guiding the yellow toner through the pipes.

The upstream transport portion 310Y has an insertion opening 312Y formed at a position at the rear side in the arrangement in the apparatus body 12 and facing the upper side. The yellow toner discharged from the discharge port 204Y (see FIG. 5A) of the toner housing container 200Y is inserted into the upstream transport portion 310Y through the insertion opening 312Y. The upstream transport portion 310Y transports the inserted yellow toner from the rear side to the front side (from the right side to the left side in FIG. 6) in the arrangement in the apparatus body 12. Also, the downstream transport portion 330Y is coupled to the upstream transport portion 310Y at a position at the front side in the arrangement in the apparatus body 12.

An upper end portion of the downstream transport portion 330Y is coupled to the upstream transport portion 310Y, and a developing device connection portion 340Y is attached to a lower end portion of the downstream transport portion 330Y. The developing device connection portion 340Y is a mechanism to which the developing device 150Y (for example, see FIG. 3) is connected. The downstream transport portion 330Y transports the yellow toner transported from the upstream transport portion 310Y to the developing device 150Y through the developing device connection portion 340Y.

FIG. 9A shows the upstream transport portion 310K. As shown in FIG. 9A, the upstream transport portion 310K has a rotational body 314K formed with a protruding portion protruding in a spiral shape. When the rotational body 314K receives driving transmission from a driving source (not shown) and hence is rotated, the upstream transport portion 310K transports the black toner from the insertion opening 312K side to the intermediate transport portion 320K side, that is, from the front side to the rear side. The rotational body 314K has a shaft portion formed with the spiral-shaped protruding portion, and the thickness of the shaft portion is different depending on the position. Since the thickness of the shaft portion is different depending on the position, the upstream transport portion 310K is able to adjust the amount of the black toner to be supplied to the intermediate transport portion 320K.

Figure 9B:
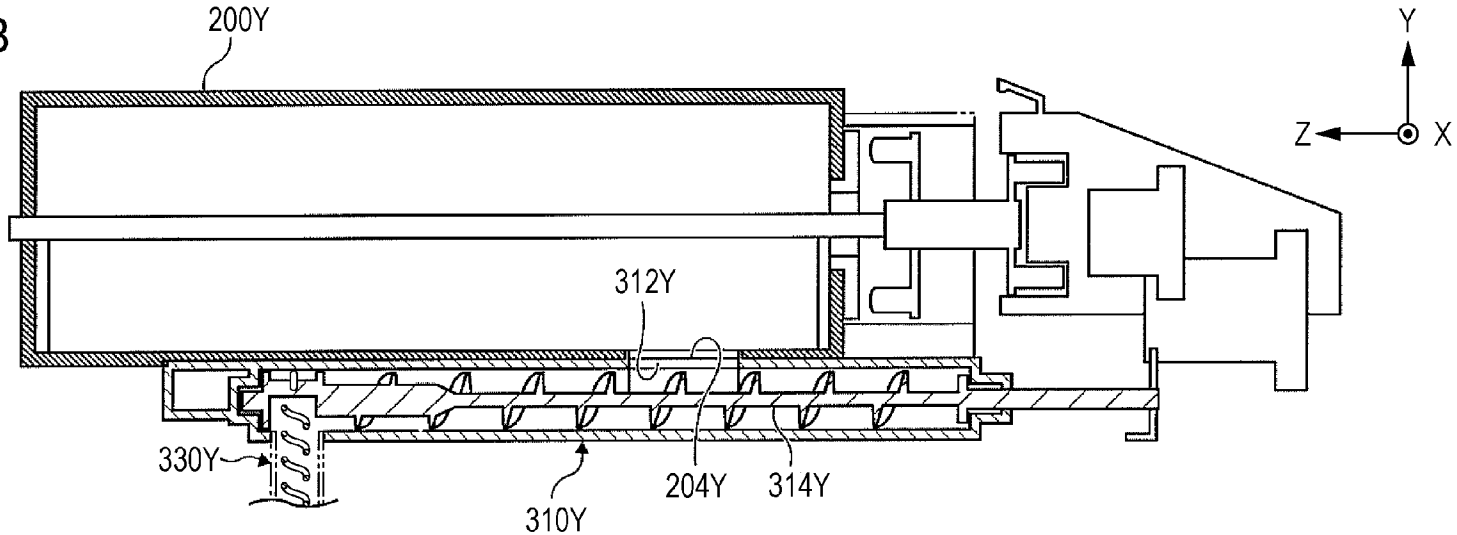
FIG. 9B is a cross-sectional view showing an upstream transport portion included in a developer transport device that transports a toner of yellow, the device which is one of the plural developer transport devices shown in FIG. 6, when viewed from a right side surface.

FIG. 9B shows the upstream transport portion 310Y. As shown in FIG. 9B, the upstream transport portion 310Y has a rotational body 314Y formed with a protruding portion protruding in a spiral shape. When the rotational body 314Y receives driving transmission from a driving source (not shown) and hence is rotated, the upstream transport portion 310Y transports the yellow toner. The upstream transport portion 310K transports the black toner from the front side to the rear side (see FIG. 9A). In contrast, the upstream transport portion 310Y transports the yellow toner from the rear side to the front side. Then, the upstream transport portion 310Y transports the yellow toner from the insertion opening 312Y side to the downstream transport portion 330Y side.

The rotational body 314Y has a shaft portion formed with the spiral-shaped protruding portion, and the thickness of the shaft portion is different depending on the position. Since the thickness of the shaft portion is different depending on the position, the upstream transport portion 310Y is able to adjust the amount of the yellow toner to be supplied to the downstream transport portion 330Y.

The upstream transport portion 310K has the rotational body 314K and the upstream transport portion 310Y has the rotational body 314Y. Similarly, the upstream transport portion 310M has a rotational body 314M (not shown), and the upstream transport portion 310C has a rotational body 314C (not shown). The rotational body 314M transports the magenta toner from the front side to the rear side. The rotational body 314C transports the cyan toner from the front side to the rear side.

Figure 10:
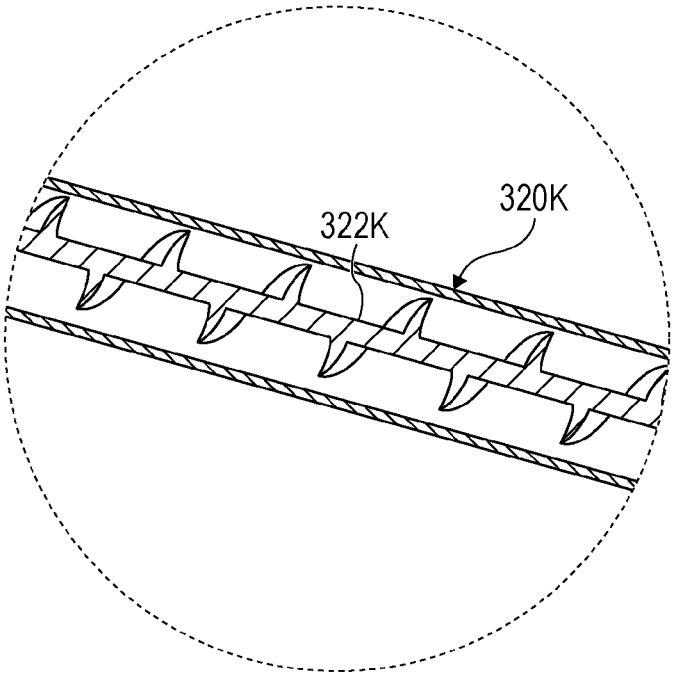
FIG. 10 is a cross-sectional view showing in an enlarged manner a portion of an intermediate transport portion included in the developer transport device that transports the developer of black, the device which is one of the plural developer transport devices shown in FIG. 6, FIG. 10 illustrating a region surrounded by a dot-line X in FIG. 7 in an enlarged manner.

FIG. 10 shows the intermediate transport portion 320K. As shown in FIG. 10, the intermediate transport portion 320K has a rotational body 322K formed with a protruding portion protruding in a spiral shape. When the rotational body 322K receives driving transmission from a driving source (not shown) and hence is rotated, the rotational body 322K transports the black toner. The intermediate transport portion 320K has the rotational body 322K. Similarly, the intermediate transport portion 320Y has a rotational body 322Y (not shown), the intermediate transport portion 320M has a rotational body 322M (not shown), and the intermediate transport portion 320C has a rotational body 322C (not shown). The rotational body 322Y transports the yellow toner while rotating, the rotational body 322M transports the magenta toner while rotating, and the rotational body 322C transports the cyan toner while rotating.

Figure 11:
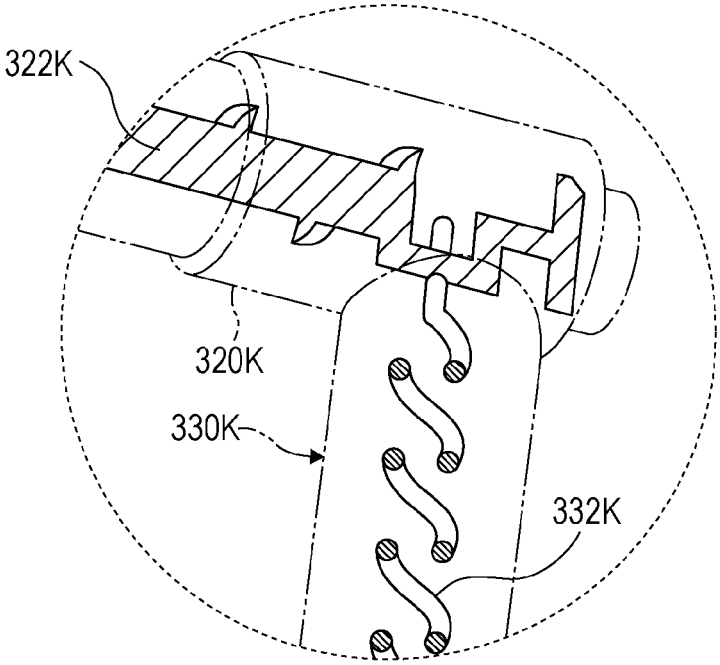
FIG. 11 is a cross-sectional view showing in an enlarged manner a portion of a downstream transport portion included in the developer transport device that transports the developer of black, the device which is one of the plural developer transport devices shown in FIG. 6, FIG. 11 illustrating a region surrounded by a dot-line XI in FIG. 7 in an enlarged manner.

FIG. 11 shows the downstream transport portion 330K. As shown in FIG. 11, the downstream transport portion 330K has a breaking member 332K. The breaking member 332K is a member that breaks the black toner solidified in the downstream transport portion 330K to prevent the toner to stay in the downstream transport portion 330K that transports the black toner so that the black toner falls.

The breaking member 332K may use, for example, a member formed by bending a long and thin rod-shaped member in a spiral shape. An upper end portion of the breaking member 332K is coupled to, for example, the rotational body 322K. Hence, when the rotational body 322K rotates, the breaking member 332K repetitively moves in the up-down direction. When the breaking member 332K repetitively moves in the up-down direction, the black toner solidified in the downstream transport portion 330K is broken.

The downstream transport portion 330K has the breaking member 332K. Similarly, the downstream transport portion 330Y has a breaking member 332Y (not shown), the downstream transport portion 330M has a breaking member 332M (not shown), and the downstream transport portion 330C has a breaking member 332C (not shown). The breaking member 332Y repetitively moves in the up-down direction and hence breaks the yellow toner solidified in the downstream transport portion 330Y. The breaking member 332M repetitively moves in the up-down direction and hence breaks the magenta toner solidified in the downstream transport portion 330M. The breaking member 332C repetitively moves in the up-down direction and hence breaks the cyan toner solidified in the downstream transport portion 330C.

In the toner transport devices 300Y, 300M, 300C, and 300K configured as described above, the upstream transport portions 310Y, 310M, 310C, and 310K are arranged in parallel to each other, and are used as parallel transport portions. At least one of the upstream transport portions 310Y, 310M, 310C, and 310K transports the toner in the direction opposite to the directions of the other transport portions. To be more specific, in this exemplary embodiment, the upstream transport portion 310Y transports the toner from the rear side to the front side (from the right side to the left side in FIG. 6), and hence transports the toner in the direction opposite to the directions of the upstream transport portions 310M, 310C, and 310K that each transport the toner from the front side to the rear side (from the left side to the right side in FIG. 6).

Also, the upstream transport portions 310Y, 310M, 310C, and 310K are arranged along the longitudinal directions of the toner housing containers 200Y, 200M, 200C, and 200K.

Also, the distances by which the toner transport devices 300Y, 300M, 300C, and 300K transport the developers are longer as the distances by which the toner transport devices 300Y, 300M, 300C, and 300K transport the developers to the developing devices 150Y, 150M, 150C, and 150K at smaller distances from the second transfer roller 122.

That is, the toner transport device 300K that transports the toner to the developing device 150K at the smallest distance from the second transfer roller 122 transports the toner by the largest distance. The toner transport device 300C that transports the toner to the developing device 150C at a distance second to the smallest distance from the second transfer roller 122 transports the toner by a distance second to the largest distance. The toner transport device 300M that transports the toner to the developing device 150M at a distance third to the smallest distance from the second transfer roller 122 transports the toner by a distance third to the largest distance. The toner transport device 300Y that transports the toner to the developing device 150Y at the largest distance from the second transfer roller 122 transports the toner by the smallest distance.

That is, among the developing devices 150Y, 150M, 150C, and 150K being plural developing devices, for example, the developing device 150K is used as a first developing device located near the second transfer roller 122; for example, the developing device 150C is used as a second developing device located farther from the second transfer roller 122 than the developing device 150K; for example, the toner transport device 300K is used as a first transport device that transports the toner to the developing device 150K; for example, the toner transport device 300C is used as a second transport device that transports the toner to the developing device 150C; and the transport distance for transporting the toner of the toner transport device 300K used as the first transport device is larger than that of the toner transport device 300M used as the second transport device.

As described above, the exemplary embodiment of the present invention may be used for an image forming apparatus, such as a copier, a printer, or a facsimile.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an apparatus body;

opening/closing portion that is openable and closable with respect to the apparatus body;

a plurality of developing devices arranged in a first direction in the apparatus body;

a plurality of developer housing containers that house developers to be respectively supplied to the plurality of developing devices, the plurality of developer housing containers being arranged in a second direction intersecting with the first direction;

a plurality of transport devices that respectively transport the developers to the plurality of developing devices respectively corresponding to the plurality of developer housing containers from the plurality of developer housing containers;

an intermediate transfer body on which developer images developed by the plurality of developing devices are transferred; and a transfer device that transfers the developer images from the intermediate transfer body to a recording medium, wherein the plurality of developing devices include a first developing device located near the transfer device, and a second developing device located farther from the transfer device than the first developing device, and wherein the plurality of transport devices include a first transport device that transports a developer to the first developing device, and a second transport device that transports a developer to the second developing device, wherein a transport distance by which the first transport device transports the developer is larger than a transport distance by which the second transport device transports the developer, wherein the plurality of developer housing containers are attached to and detached from the apparatus body through an open portion formed when the opening/closing portion is opened, and wherein a first angle between the first transport device and the first developing device is different from a second angle between the second transport device and the second developing device.

2. The image forming apparatus according to claim 1, wherein the plurality of developing devices develop developer images with colors different from each other, wherein the plurality of developer housing containers house developers with the different colors respectively used by the plurality of developing devices, and wherein an order in the first direction of the colors of the developer images respectively developed by the plurality of developing devices is the same as an order in the second direction of the colors of the developers respectively housed in the plurality of developer housing containers.

3. The image forming apparatus according to claim 1, further comprising:

an output portion to which a recording medium with a developer image formed is output, wherein the plurality of developer housing containers are arranged below the output portion.

4. The image forming apparatus according to claim 1, further comprising:

an opening/closing portion that is openable and closable with respect to the apparatus body, wherein the plurality of developer housing containers are attached to and detached from the apparatus body through an open portion formed when the opening/closing portion is opened.

5. The image forming apparatus according to claim 1, further comprising:

a recording medium housing portion that houses a recording medium, the recording medium housing portion being able to be pulled out from the apparatus body, wherein the plurality of developer housing containers are moved in a direction the same as a direction in which the recording medium housing portion is pulled out and are detached from the apparatus body, and the plurality of developer housing containers are moved in a direction opposite to the direction in which the recording medium housing portion is pulled out and are attached to the apparatus body.

6. The image forming apparatus according to claim 1, wherein the plurality of developer housing containers are moved in a direction the same as a direction in which a recording medium with an image formed is output from the apparatus body and are detached from the apparatus body, and the plurality of developer housing containers are moved in a direction opposite to the direction in which the recording medium with the image formed is output from the apparatus body and are attached to the apparatus body.

7. The image forming apparatus according to claim 1, wherein the plurality of transport devices respectively include a plurality of parallel transport portions that transport the developers and are arranged in parallel to each other, and wherein at least one of the parallel transport portions transports the developer in a direction opposite to directions in which the other parallel transport portions transport the developers.

8. The image forming apparatus according to claim 7, wherein the parallel transport portions are arranged respectively along longitudinal directions of the developer housing containers.

9. An image forming apparatus comprising:

an apparatus body;

a plurality of developing devices arranged in a first direction in the apparatus body;

a plurality of developer housing containers that house developers to be respectively supplied to the plurality of developing devices, the plurality of developer housing containers being arranged in a second direction intersecting with the first direction;

a plurality of transport devices that respectively transport the developers to the plurality of developing devices respectively corresponding to the plurality of developer housing containers from the plurality of developer housing containers;

an intermediate transfer body on which developer images developed by the plurality of developing devices are transferred; and a transfer device that transfers the developer images from the intermediate transfer body to a recording medium, wherein the plurality of developing devices include a first developing device located near the transfer device, and a second developing device located farther from the transfer device than the first developing device, and wherein the plurality of transport devices include a first transport device that transports a developer to the first developing device, and a second transport device that transports a developer to the second developing device, wherein a transport distance by which the first transport device transports the developer is larger than a transport distance by which the second transport device transports the developer, and wherein the plurality of developer housing containers are moved in a direction the same as a direction in which a recording medium with an image formed is output from the apparatus body and are detached from the apparatus body, and the plurality of developer housing containers are moved in a direction opposite to the direction in which the recording medium with the image formed is output from the apparatus body and are attached to the apparatus body.

10. An image forming apparatus comprising:

an apparatus body;

a plurality of developing devices arranged in a first direction in the apparatus body;

a plurality of developer housing containers that house developers to be respectively supplied to the plurality of developing devices, the plurality of developer housing containers being arranged in a second direction intersecting with the first direction;

a plurality of transport devices that respectively transport the developers to the plurality of developing devices respectively corresponding to the plurality of developer housing containers from the plurality of developer housing containers;

an intermediate transfer body on which developer images developed by the plurality of developing devices are transferred; and a transfer device that transfers the developer images from the intermediate transfer body to a recording medium, wherein the plurality of developing devices include a first developing device located near the transfer device, and a second developing device located farther from the transfer device than the first developing device, and wherein the plurality of transport devices include a first transport device that transports a developer to the first developing device, and a second transport device that transports a developer to the second developing device, wherein a transport distance by which the first transport device transports the developer is larger than a transport distance by which the second transport device transports the developer, wherein the plurality of transport devices respectively include a plurality of parallel transport portions that transport the developers and are arranged in parallel to each other, and wherein at least one of the parallel transport portions transports the developer in a direction opposite to directions in which the other parallel transport portions transport the developers.

* * * * *